US006135041A

United States Patent [19]

Hamata

[11] Patent Number: 6,135,041

[45] Date of Patent: Oct. 24, 2000

[54] HULL FOR A SAILING VESSEL

[75] Inventor: Bruno Hamata, Himberg, Austria

[73] Assignee: Maria Hamata, Himberg, Austria

[21] Appl. No.: 09/214,778

[22] PCT Filed: Jul. 10, 1997

[86] PCT No.: PCT/AT97/00162

§ 371 Date: Jan. 8, 1999

§ 102(e) Date: Jan. 8, 1999

[87] PCT Pub. No.: WO98/02346

PCT Pub. Date: Jan. 22, 1998

[30] Foreign Application Priority Data

Jul. 12, 1996 [AT] Austria ..... 1260/96

[51] Int. Cl.[7] ..... B63B 35/79; B63B 17/00

[52] U.S. Cl. ..... 114/39.21; 114/361

[58] Field of Search ..... 114/39.21, 65 R, 114/71, 56.1, 361, 66, 70, 85

[56] References Cited

U.S. PATENT DOCUMENTS 1,750,695 3/1930 Trumpy .
2,278,706 4/1942 Laufersweiler et al. .
4,641,600 2/1987 Halvorsen ..... 114/361
5,552,769 9/1996 Riordan ..... 340/550
5,605,480 2/1997 Wright ..... 440/43

FOREIGN PATENT DOCUMENTS 533457 11/1940 United Kingdom .

OTHER PUBLICATIONS

"A New Sail Training Vessel for the Handicapped" (Ship & Boat International Mar. 1996).
"AXSURF" (Ship & Boat International Dec. 1995).
SIDDHARTA (advertisement) 1997.

*Primary Examiner*—S. Joseph Morano
*Assistant Examiner*—Patrick Craig Muldoon
*Attorney, Agent, or Firm*—Herbert Dubno

[57] ABSTRACT

A sailing vessel has a hull of a low-profile construction with a work deck overhanging the accommodation area extending substantially from the midsection of the hull to a terrace deck adjacent the stern. Continuous openings along the port and starboard sides are closeable with a watertight shutter extending between the work deck and the waterline. This shutter is formed by a roller blind guided in track along opposite edges of the opening and sealed to prevent the sea from entering the accommodation area.

7 Claims, 3 Drawing Sheets

HULL FOR A SAILING VESSEL

CROSS REFERENCE TO RELATED APPLICATIONS

Figure 1:
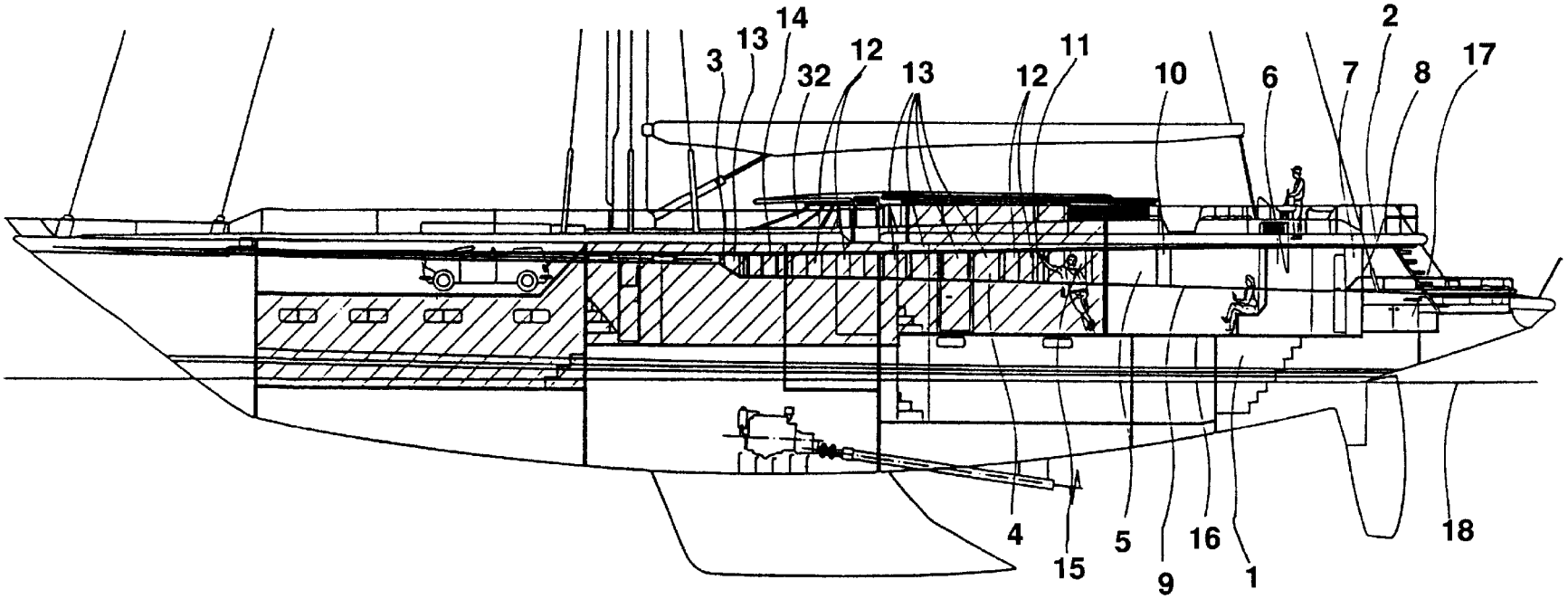

This application is a national stage of PCT/AT97/00162 filed Jul. 10, 1997 and based upon Austrian national application A 1260/96 of Jul. 12, 1996 under the International Convention.

FIELD OF THE INVENTION

The invention relates to a hull for a sailing vessel with a continuous work deck extending substantially from the prow to the stern, on which a deck house is arranged only slightly rising above the work deck in order to avoid wind-exposed surfaces, and with cabins and a main living deck with an adjacent terrace deck below the same.

BACKGROUND OF THE INVENTION

A sailing vessel consists of a hull which is connected in a water-tight manner to the body of the vessel by a deck (called sailing deck or work deck). Optionally on this deck there are superstructures, also called deck houses—which increase the living space, and the comfort on board. However these deck houses, often receiving the inner control consoles, have various disadvantages, such as a high resistance to air due to their height above deck, or safety problems due to the use of large glass windows. Also there are natural limitation to the size of the superstructures.

In order to avoid these disadvantages, the main living space on board, including the parlor, was placed in the hull, which has the drawback of a "cellar feeling" without a view.

The state of the art can be known from the leading yachting magazines, namely Boat International—England, Meer & Yachten, respectively Boote Exclusiv—Germany, Yacht Capital—Italy, and Showboats International—USA, in the form of vessel descriptions. Typical articles are:

"Segelyacht Liberty" in Meer & Yachten No. 2/98

"Die grössten Segelyachten der Welt—Top 100" in Boote Exclusiv No. 2/98

"Sailing Yacht Surama" in Boat International October 1997.

It is the object of the invention to achieve an improved use of a hull for a sailing vessel, and to change the context of space division on and below deck, with the following objectives:

The creation of generous accommodations and living quarters on and below deck, taking into consideration that a sailing vessel has to have a low profile (tall superstructures are not favorable for the sailing quality of the vessel).

The creation of good light and air supply to the main rooms and cabins of the vessel, also during unfavorable weather conditions.

The creation of easily accessible large storage rooms, which can be reached also in bad weather and which also make the best use of the body of such a vessel.

This is achieved due to the fact that at port as well as star board, between the work deck 2 and the water lime 18, in the longitudinal ship's side 3, an opening which can be closed to be at least watertight is provided, continuously extending over the length of the accommodation area 4, 5 all the way to the stern, for providing light and air, as well as an unobstructed view.

The rear half of the work deck is therefore free-standing, i.e. only partially connected to the hull, so that between the hull and the deck there is a free space. This space can be used in many ways, e.g. as an open terrace or as a side passage to the forward quarter. During bad weather, respectively too much listing of the vessel, this space between work deck and hull can be closed by a watertight roller blind. Due to this features, the cabin and living area can be basically located below the work deck, whereby the advantages of free panoramic view and fresh air are preserved.

Further advantages are: Good utilization of the hull volume, which is not the case in deck houses. The cabins, respectively living rooms can be equipped with a number of glass surfaces increasing from the front to the rear, which finally ends in the parlor with "glass house", and after that continues at the same level with an open "terrace". This terrace is a free space completely covered by a roof, which depending on need and weather conditions, can be completely or partially closed. Further in this area of the vessel a "glass house" to be used as dwelling area is possible only if equipped with additional protection against bad weather, e.g. a roller blind.

The essential advantage however is that this does not require tall superstructures and a low-profile vessel can be achieved.

Figure 2:
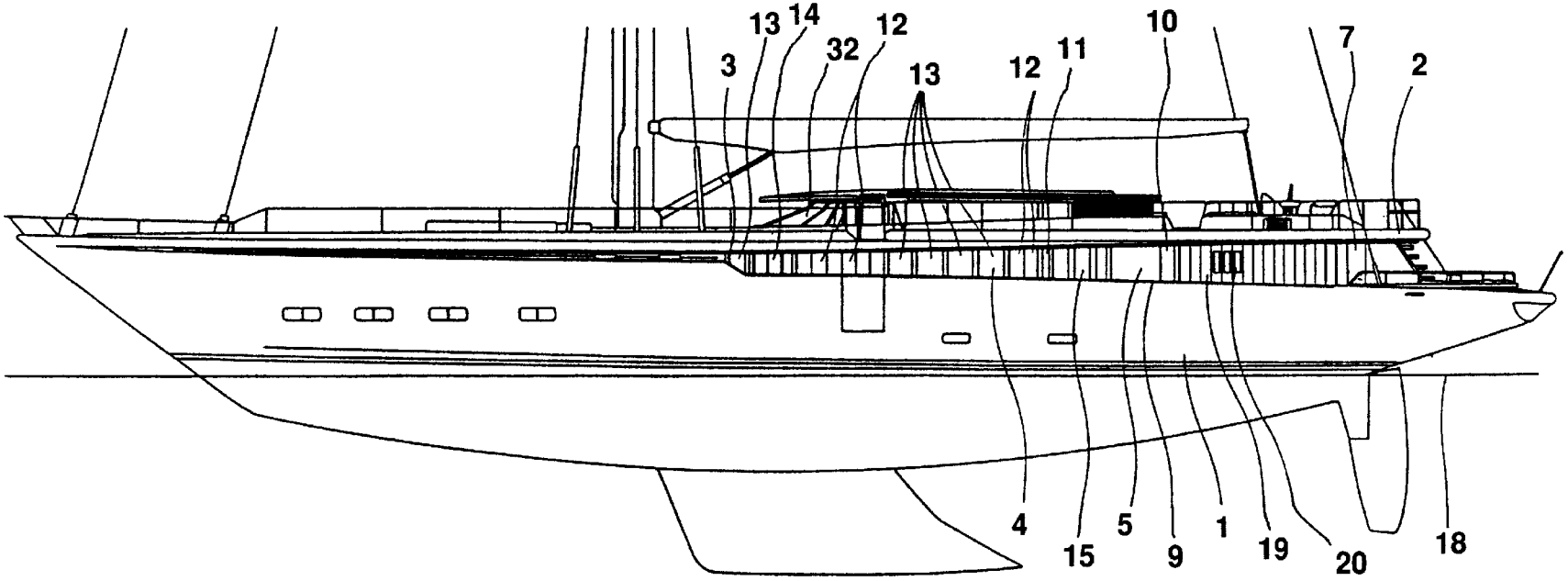

In the following the invention is closer described with the aid of an example and with reference to the attached drawing. This shows:

FIG. 1 a side view of a sailing vessel with open roller blind,

FIG. 2 a side view of the sailing vessel with partially closed roller blind.

Figure 3:
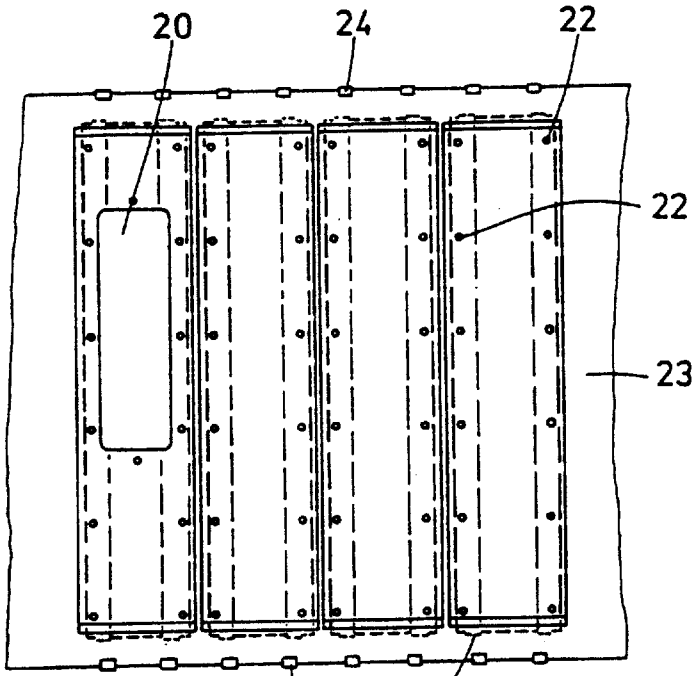

FIG. 3 the construction of the watertight special roller blind.

Figure 4:
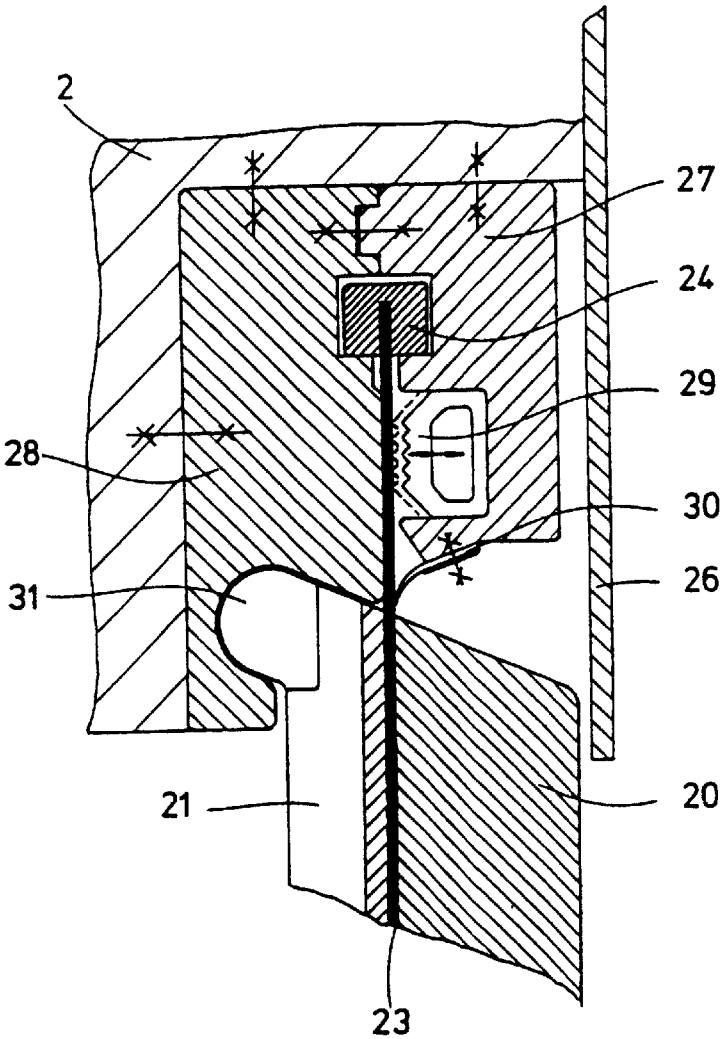

FIG. 4 the section through a guide track of the roller blind.

FIG. 1 represents a profile of a sailing vessel(length approximately 36 m) wherein also the various decks levels can be seen. The hull of the vessel separates itself from the work, respectively sailing deck 2 approximately at the half length 3, so that at port and starboard sides an opening is formed in the ship's side, which extends over the length of a dwelling area consisting of the main living deck 4 continued by terrace deck 5, whereby the living area is increased towards the stern. A column-like connection 6 between deck 2 and ship's side limits this terrace in the direction of the stern and also contains the rear part of a roller blind 19 in a rear column 7 and is important for the stability of the work deck 2. The connection 6 has various functions, among others it contains two (watertight closable) sliding doors 8, which insure the passage to the stern area of the vessel. The watertight roller blind 19 can be closed in two tracks, which are arranged on the one side in the breastwork 9 and on the other side in the deck 2, up to a middle column 10. In the middle column 10 a further roller blind is lodged, which can be closed up to a front column 11 of the vessel. From the front column 11 up to the split point of hull 1 and deck 2, the outer shell of the vessel is alternately closed off by fixed columns 12, fixed armored glass panes 13 and a window 14 which can be opened. A parlor continues astern with a glass house 15. The floors 16 of the parlor and terrace are at the same level. The breastwork 9 (terrace area) is connected to the hull 1 in a watertight manner, so that in the floor area of the terrace 16 no water can penetrate from the outside. In this area for the evacuation of the splash water drainage pipes are provided in the floor 16. This lower-lying living and terrace area can therefore be completely closed off, from the split point to the wall by means of the sliding doors 8 and the rear column 7. When the sliding doors are closed, the remaining open stern area 17 of the vessel is this way separated from the rest of the terrace in a watertight manner, and contains large drainage openings in the breastwork 9, respectively stern area 17.

The water line of the vessel is marked with 18. The low deck house (with inner control console) is marked 32.

FIG. 2 shows the same side view as FIG. 1, but without illustrating the various living levels and with partially closed (rear) roller blind 19. The closed rear roller blind is provided with several polycarbonate windows 20. This roller blind seals off the free space from the rear column 7 up to the middle column 10 on the outer shell of the hull 1 and the outer edge of the deck 2, see FIG. 3 and 4. The second roller blind would seal off the area between the middle column 10 and the front column 11 located at the outer shell of the vessel, but it is shown open, i.e. wound up in the middle column 10 and allows a free view of the inner parlor glass house 15. The remaining components are marked with the same reference numerals as in FIG. 1.

Figure 3A:
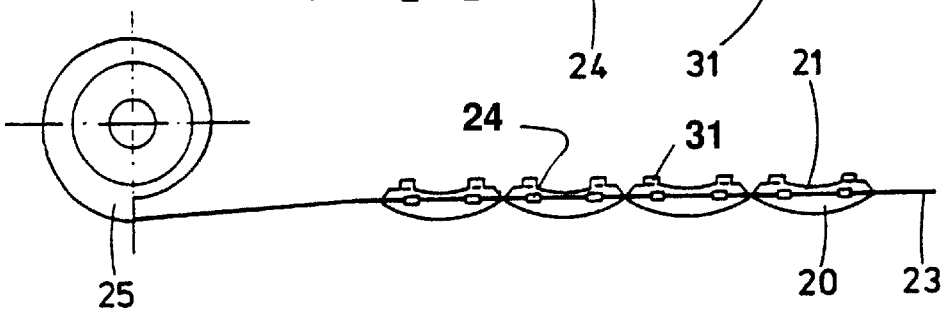

FIGS. 3 and 3*a* show the watertight roller blind 19. Thereby an outer part 20 and an inner part 21 are screwed together by means of rustproof screws 22. These roller blind parts 20, 21 are made of a composite material (reinforcement fibers of kevlar and epoxy resins. Between these two roller blind parts runs a woven sheet 23 over the entire length of the roller blind. This woven sheet 23 consists of kevlar-reinforced Teflon (PTFE). Windows 20 made of polycarbonate are additionally provided. Sliders 24 (polyamide 66) are secured by screws on both sides of the woven sheet 23 and serve for its precise guidance. The roller blind can be wound on a spiral-shaped roller 25, if needed.

In FIG. 4 a section through a slide track is represented, which on the one side is mounted in the work deck 2 and on the other side in the breastwork 9, and wherein the roller blind 19 can be pulled open or shut. The drawing shows the upper slide track, therefore 2 is the deck, further a covering panel 26 of the outer shell of the vessel, as well as two plastic slide tracks 27, 28 screwed to each other can be seen. A rubber sealing system 30, inflatable with compressed air, seals off the woven sheet 23. An additional rubber sealing lip 30 closes off the entire system when the roller blind is wound up, in order to prevent dirt from entering the slide track. Semicircular cams 31, which are formed on the inner part 21, serve not only as a guide element, but have also the function of an articulation, in order to impart a higher degree of elasticity to the roller blind under load.

I claim:

1. A sailing vessel comprising:

a hull having a bow, a stern, port and starboard sides and a waterline;

a work deck on said hull extending substantially from said bow to said stern and defining with said hull along said port and starboard sides, respective horizontal openings extending substantially continuously over an accommodation space in said hull running from about a midsection of said hull to a terrace at said stern;

a low-profile deckhouse on said work deck; and respective dischargeable watertight closures along said sides and adapted to span said openings substantially between said waterline and said work deck to seal said accommodation space from weather.

2. The sailing vessel defined in claim 1 wherein said work deck in a region of said stern extends beyond said accommodation space and said closures.

3. The sailing vessel defined in claim 2 wherein said closures are roller blinds spanning across said openings and wound on rollers received in columns bridged between said work deck and said hull.

4. The sailing vessel defined in claim 3 wherein each of said roller blinds comprises a continuous fiber-reinforced rubber sheet having tightly arranged composite components secured to said sheet on opposite sides thereof and connected by screws.

5. The sailing vessel defined in claim 4 wherein said blinds have semicircular protrusions extending into plastic tracks, an inflatable seal and a lip seal extending along each of said tracks to seal the accommodation space from the sea.

6. A sailing vessel comprising:

a hull having a bow, a stern, port and starboard sides and a waterline;

a work deck on said hull extending substantially from said bow to said stern and defining with said hull along said port and starboard sides, respective horizontal openings extending substantially continuously over an accommodation space in said hull running from about a midsection of said hull to a terrace at said stern;

a low-profile deckhouse on said work deck;

respective columns spanned across said openings; and respective watertight closures along said sides and adapted to span said openings substantially between said waterline and said work deck to seal said accommodation space from weather, said closures being roller blinds wound on rollers of the respective columns and bridging between the waterline and the work deck, each of said roller blinds being formed as a continuous fiber-reinforced rubber sheet provided with tightly arranged composite components affixed thereto along opposite sides of the sheet.

7. A sailing vessel comprising:

a hull having a bow, a stern, port and starboard sides and a waterline;

a work deck on said hull extending substantially from said bow to said stern and defining with said hull along said port and starboard sides, respective horizontal openings extending substantially continuously over an accommodation space in said hull running from about a midsection of said hull to a terrace at said stern;

a low-profile deckhouse on said work deck;

respective columns spanned across said openings;

plastic tracks along opposite sides of each of said openings; and respective watertight closures along said sides of said hull and adapted to span said openings substantially between said waterline and said work deck to seal said accommodation space from weather, said closures being roller blinds wound on rollers of the respective columns and bridging between the waterline and the work deck, each of said roller blinds being formed as a continuous fiber-reinforced rubber sheet provided with guide components affixed thereto along opposite edges and guided in said tracks, said guide components having semicircular plastic noses, said closures including a lip seal and an inflatable seal along each of said tracks engageable with said rubber sheet of the respective closure.

* * * * *